US005081723A

United States Patent [19]

Saunders

[11] Patent Number: 5,081,723

[45] Date of Patent: Jan. 21, 1992

[54] PLAYPEN WITH DETACHABLE SIDES USED AS SECURITY GATES

[76] Inventor: David R. Saunders, 10 Fox Chapel, Williamsville, N.Y. 14221

[21] Appl. No.: 742,330

[22] Filed: Aug. 8, 1991

[51] Int. Cl.[5] ..... A47D 7/02; A47D 11/00; A47D 13/06

[52] U.S. Cl. ..... 5/100; 5/93.1; 256/1; 256/25

[58] Field of Search ..... 5/99.1, 100, 93.1, 98.1; 256/25, 1

[56] References Cited

U.S. PATENT DOCUMENTS

| | | | |
|---|---|---|---|
| 2,442,048 | 5/1948 | Kroll et al. | 5/100 |
| 2,491,577 | 12/1949 | Olinger | 256/25 |
| 2,563,446 | 8/1951 | Abel | 256/25 |
| 2,619,249 | 4/1952 | Whittington | 220/8 |
| 2,689,960 | 9/1954 | Lax | 5/93.1 |
| 2,713,505 | 7/1955 | Luger | 256/25 |
| 3,064,305 | 11/1962 | Hill | 256/25 |
| 3,886,607 | 6/1975 | Dunn | 5/99.1 |
| 4,008,497 | 2/1977 | Badon | 5/99.1 |
| 4,714,169 | 12/1987 | Keenan et al. | 220/8 |

FOREIGN PATENT DOCUMENTS

| | | | |
|---|---|---|---|
| 1547739 | 11/1968 | France | 5/93.1 |
| 546053 | 6/1942 | United Kingdom | 256/25 |
| 1182182 | 2/1970 | United Kingdom | 5/100 |

*Primary Examiner*—Alexander Grosz
*Attorney, Agent, or Firm*—James J. Ralabate

[57] ABSTRACT

The invention involves a novel playpen structure. The playpen looks like a conventional playpen except that it has at least one removable side portion that can be used as a security gate. The removable side (or enclosed structure) portion has both a connecting structure for connecting it to the remainder of the enclosed structure and a securing structure which is used to secure the removable side portion to a door frame when used as a security gate.

17 Claims, 4 Drawing Sheets

PLAYPEN WITH DETACHABLE SIDES USED AS SECURITY GATES

This invention relates to a playpen with removable sides and, more particularly, to a playpen with detachable sides which can be used separately as security gates.

BACKGROUND OF THE INVENTION

It is known in the art to provide playpens for children that have collapsible sides so that the playpen can be transported from one location to another. It is also known to utilize cribs or playpens that can be disassembled for storage or transportation later to be reassembled for use. There also are other prior art structures that can be adjusted or disassembled as the need requires it.

In U.S. Pat. No. 2,619,249 (Whittington) an adjustable crate structure for handling live fowl is disclosed having rectangular frames. These frames can be expanded upwardly to accommodate larger fowl such as turkeys or can be lowered to accommodate smaller fowl such as chickens. Each side has locking means to fix the adjusted side in position. None of the sides of the crate are detachable or usable for additional purposes.

U.S. Pat. No. 3,886,607 (Dunn) describes a collapsible play crib that is rotatable such as a Lazy Susan. The Dunn crib also oscillates vertically at the same time as it is rotating. The Dunn structure is collapsible for storage or transportation but it has no removable sides nor can it be used for purposes other than as a playpen or play crib.

U.S. Pat. No. 4,008,497 (Badon) discloses a swimming pool playpen having an adjustable support means for resting the playpen upon the water bottom. The enclosure portion of Badon's swimming pool is constructed of a rigid frame over which a foraminous material is mounted. Again, Badon's structure has no removable parts utilized for purposes other than that of a swimming pool playpen.

The Keenan U.S. Pat. No. 4,714,169 discloses a collapsible or expandable shipping rack with a generally rectangular bottom wall. A pair of oppositely disposed end walls of Keenan's device are hinged and secured to the bottom wall. These end walls can be pivoted from an upright position to a collapsed position over the bottom wall for storage of the rack. Removable side rails are provided which are removed by unlatching a locking means to permit pivoting of the end walls into a collapsed position over the bottom wall. The removable side rails of Keenan are removable for storage on the bottom of his rack; they are not removable for use for purposes other than his shipping rack.

SUMMARY OF THE INVENTION

It is therefore an object of this invention to provide a novel playpen structure devoid of the above-noted disadvantages.

Another object of this invention is to provide a playpen with at least one removable side usable as a security gate.

A further object of this invention is to provide a novel playpen having a relatively uncomplicated structure easily transported or stored.

A still further object of this invention is to provide a novel playpen structure that has detachable elements usable for purposes other than as a playpen component.

Another yet further object of this invention is to provide a novel playpen that is easily foldable, relatively lightweight and yet substantially reliable in use.

Yet another object of this invention is to reduce the number of disposal units. When the playpen is old and disposable, one needs only to dispose of a playpen rather than a playpen and gate.

Still yet another object of this invention is to provide a playpen having from one to all removable sides, each removable side utilizable as a security gate.

These and other objects of this invention which will become apparent upon a reading of this disclosure are provided by a playpen structure having an enclosed structure with from one to all removable sides. Each removable side has at least one securing means that will securely contact the frame of a door so that the side can be used as a security gate. The invention intends that playpens having only one or all sides removable are within the spirit of this invention. Also, each side can have one or a plurality of panels each cooperating with, slidable upon or movable from each other. When one side is removed and used as a security gate or a room divider or the like, the vacant side can be pushed against a wall as part of the enclosed structure so that the playpen can still be used as such while the removed side is used as a security gate.

The removed side in addition to a connecting means is provided with means to secure the side or gate to the frame of a door. For example, telescoping rods may be used where pressure is provided outwardly against the door frame or door jam. This type securing means would be similar to a pressure pole used across bath tubs to support shower curtains and the like. Another type of securing means would be sliding parallel sides similar to a portable screen that open to various lengths and fit in a window or the like. Also, an expansion gate could be used or sides with clamps or other end or side locking means or any other suitable securing means capable of contact with or attachment to a door frame. The enclosed structure of this invention is the entire upwardly projecting structure which forms a fence-like enclosure perpendicular to the floor section. The body (non-frame) portion of the playpen may be made of conventional soft mesh material, rigid materials such as vinyls or wood, rails, or any other suitable material. A critical feature of this invention is that the playpen side be removable and subsequently be useful as a security gate. There must be means capable of both functioning as a playpen side with means to connect to the other playpen sides and also means capable of functioning as a door frame securing means when used as a security gate. While it is highly preferred that the playpen of this invention have a square or rectangular configuration, other playpen shapes, if suitable, can be used. For example, an octagonal or circular or other suitable configuration can be used if a removable vertical portion can be separated therefrom and used as a security gate. The width of each side must be at least 24 inches to about 60 inches or more to accommodate most standard size door openings. Some sides can have a double structure slidable on each other such as a window screen, thereby measuring 24 inches in its closed position and up to 60 inches when it is pulled out to its expanded position. However, any size door opening irrespective of how large or small may be accommodated by the present invention. There must be securing means in each removable side that will permit the side to be safely used as a security gate. For example, spring pressure means can be provided at the end terminal sections of each side or can be located in the center urging each terminal end section against the door frame. Spring means can be located in any location of the removable side to put outward pressure on the door frames. Hooks or other connecting means can be used to connect each side to the other when used as a component side of a playpen. By "connecting means" is intended throughout this disclosure and claims to mean, means to connect one side to the other adjacent sides or a support post or other components of a playpen to provide adequate strength to the playpen. This can be in the form of springs, tongue and grooves, screws, bolts, latches, sockets, hooks or any other suitable connecting device. "Securing means" is intended throughout this disclosure and claims to mean, means to securely contact or position the removed side and hold it against a door frame to provide a safe security gate. This can be in the form of spring loaded sides, brackets, extensions, slots, grooves, hooks, locks, screws and any other suitable securing device. The use of the term rectangular is intended to include both squares and other rectangles.

The sides and other components of the playpen of this invention may be made from plastic, lightweight metal, fiberglass, wood or other suitable materials. The body or webbing can be made from mesh such as vinyl-coated wire mesh, fabric, cloth, plastic, fiber mesh or any other suitable webbing. Also, in lieu of mesh can be expansion type sides, posts, rails or the like. A critical feature of this invention is that at least one side be removable and that removable side or sides have both connecting and securing means therein.

DESCRIPTION OF THE DRAWING AND THE PREFERRED EMBODIMENTS

All of the embodiments of the above figures have removable sides that are adjustable to fit any size door openings when used as a security gate. It is critical, however, as noted above, that each removable side contain both a securing means and a connecting means.

Figure 1:
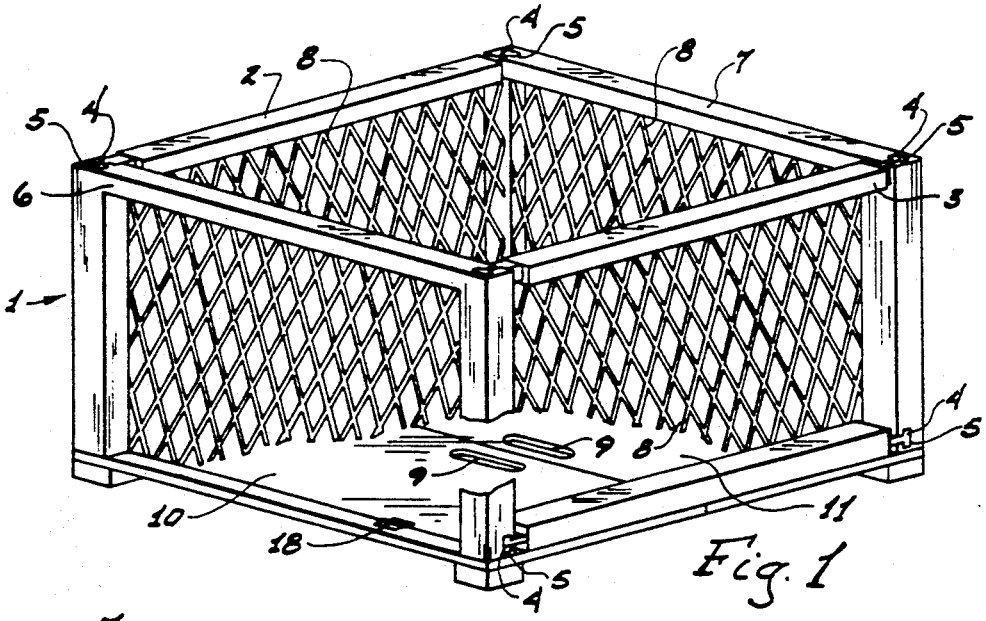
FIG. 1 is a perspective view of a playpen embodiment of this invention with two removable sides.
Figure 2:
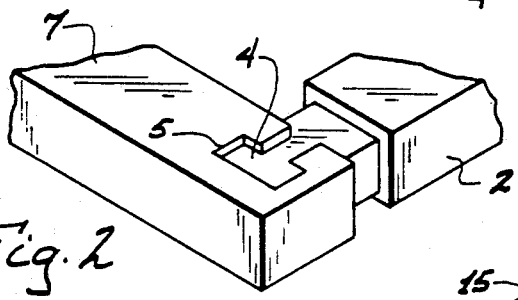
FIG. 2 is an enlarged perspective view of the connecting means of FIG. 1 removable sides.
Figure 3:
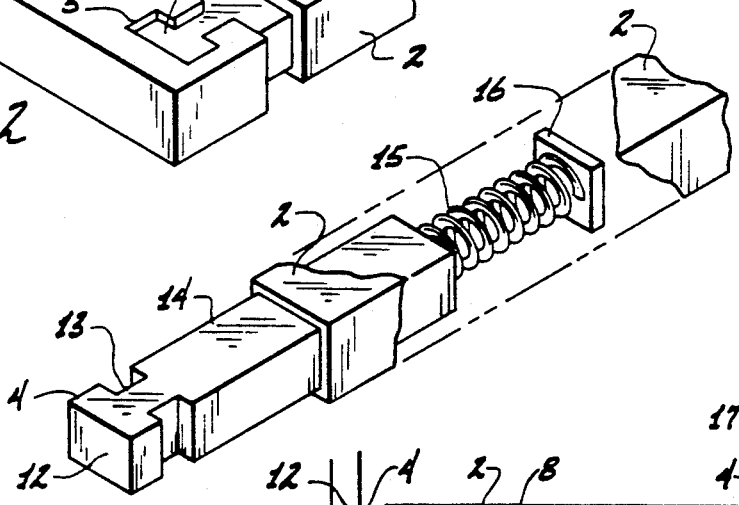
FIG. 3 is a breakaway view showing the spring-loaded securing-connecting means of FIG. 1.
Figure 4:
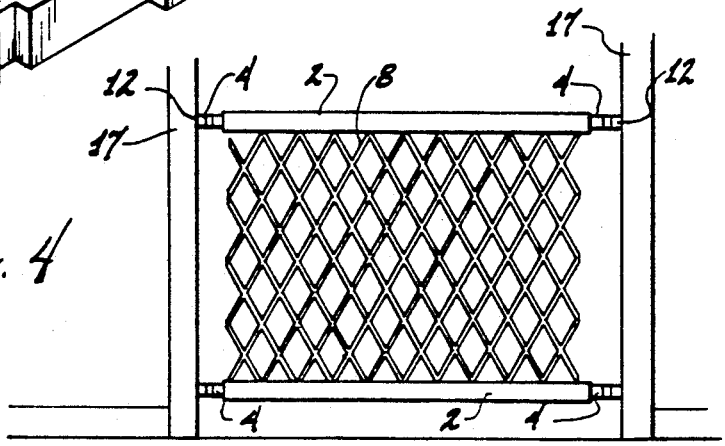
FIG. 4 is a plan view illustrating a removable side being used as a security gate.

In FIG. 1 a side perspective view of a playpen 1 having two removable sides 2 and 3 is shown. Here the connecting means of these removable sides is made up of T-shaped extension 4 which fits into a slot 5 in the non-removable sides 6 and 7. If four removable sides are to be used there would be vertical posts in each corner of the playpen. Each post would have a slot on each side to receive the T-shaped connecting means of the four removable sides. The playpen 1 has conventional mesh or other sides 8 made from fabric, wood, plastic or any other suitable material. When removable sides 2 and 3 are detached from the playpen 1 the playpen is merely folded as is a conventional playpen. The playpen can be folded or otherwise compacted for storage when not in use. Any suitable means may be used to prepare or compact or fold the playpen for storage. However, when only one security gate is required, the side opposite the removed side needs to be detached before folding. Handle means 9 (which may be holes) are pulled up folding bottom portions 10 and 11 as in a conventional playpen. Hinges 18 are provided on the floor sections 10 and 11 for easy folding. Any suitable type hinge means may be used. When the playpen 1 is to be reconstructed, sides 2 and 3 with connecting means 4 are fitted into slots 5 in the non-removable sides 6 and 7 both at the top and at the bottom. The slots 5 can be open or located in the top face of the terminal portions of sides 6 and 7. At the bottom, the slots would be on the outside face of the terminal portions of sides 6 and 7 for easy accessibility as shown in FIG. 1. In lieu of slots being on the top face or outside face, a channel can be located through the length of corner posts or non-removable side corners and the connecting means can be inserted from the top and slid down the channel to fit the side in place. Since T-shaped connecting means are under pressure and are spring-loaded, they will seat firmly in grooves or slots 5 and be held in position. In some cases and in some embodiments of this invention, the connecting means and securing means are the same structure; in others such as in FIGS. 8 and 9, they are different structures or components. When sides 2 and 3 are removed they each can be used as a security gate in a door opening or the like as shown in FIG. 4. There can be from one to four removable sides, if desired, in all embodiments of the present invention. In FIG. 2 an enlarged view of a removable side 2 connected to a non-removable side 7 is shown at the top portion of the playpen. A slot 5 in non-removable side 7 receives the T-shaped spring-loaded connecting means 4 to hold the sides securely in position when the removable sides 2 and 3 are used in the playpen. If one side is removed for use as a security gate for example, if side 2 is removed only, and sides 3, 6 and 7 remain as component sides to allow continued use of the structure as a playpen, the open side caused by the removal of side 2 can be pushed up against a wall to provide a barrier which will prevent an infant from falling out of the playpen. In FIG. 3 the terminal portion of removable side 2 is broken away so that the spring-loading can be shown. The T-shaped connecting means 4 (which is also the securing means) has a flat outer surface 12 which is preferably made of a rubber or other non-skid material. Connecting means 4 has a neck portion 13 and an inner plunger section 14. Section 14 contacts an internally-housed spring 15 which exerts a constant outward pressure upon connecting means 4 thereby holding it in position when used as the connecting means or as the securing means of FIG. 4. Spring 15 abuts against section 14 of connecting means 4 on one end and abuts against internal stationary panel 16 within side 2 on its other end.

In FIG. 4 one side has been removed from playpen 1 such as removable side 2. It is fit in a door opening between door frames 17 and used as a security gate. Spring-loaded and movable securing means 4 can be adjusted or pushed in to fit any size door opening. If door openings from 36–40 inches, for example, are to be used, the two securing means 4 on each end can be made to be movable at least two inches each with side 2 being about the remainder length to accommodate these openings. Securing means 4 as shown in FIGS. 2 and 3 telescopically fit into the main section of sides 2 and 3 and will move therein in a spring-loaded fashion. Thus, in this embodiment, component 4 is both the connecting means (when used in a playpen) and as a securing means (when used as a component of a security gate).

Figure 5:
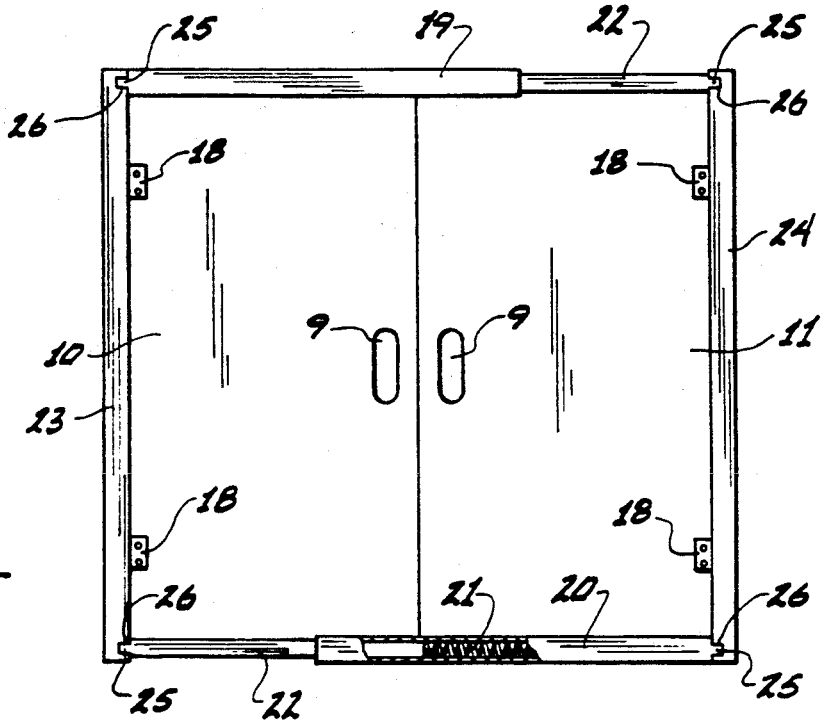
FIG. 5 is a top plan view of a playpen with another embodiment, where the removable sides comprise telescoping tubes having spring center pressure means.
Figure 6:
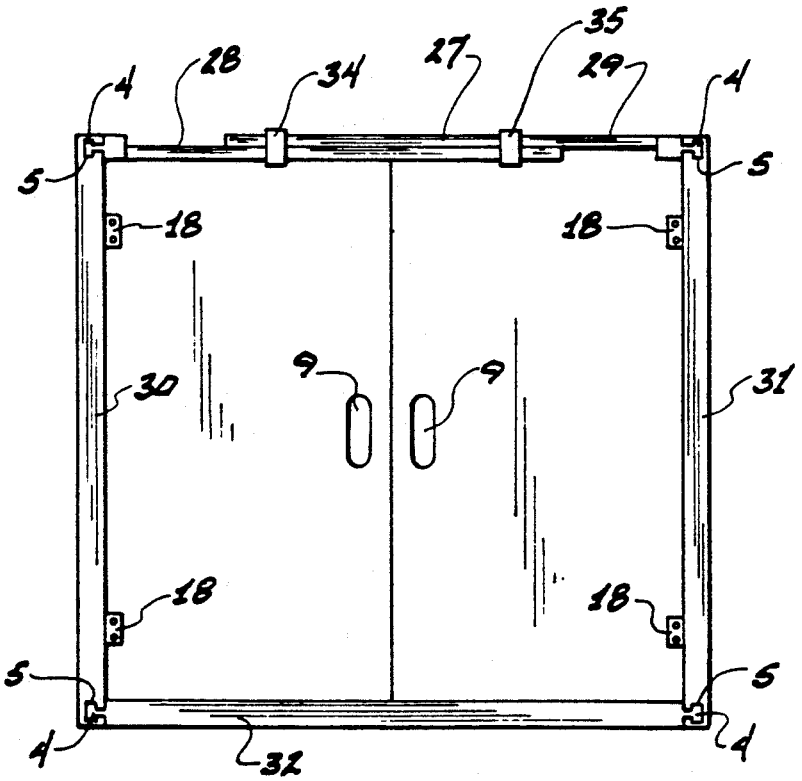
FIG. 6 is a top plan view of a playpen with another embodiment where the removable side or sides is a double sliding configuration similar to a removable window screen.
Figure 7:
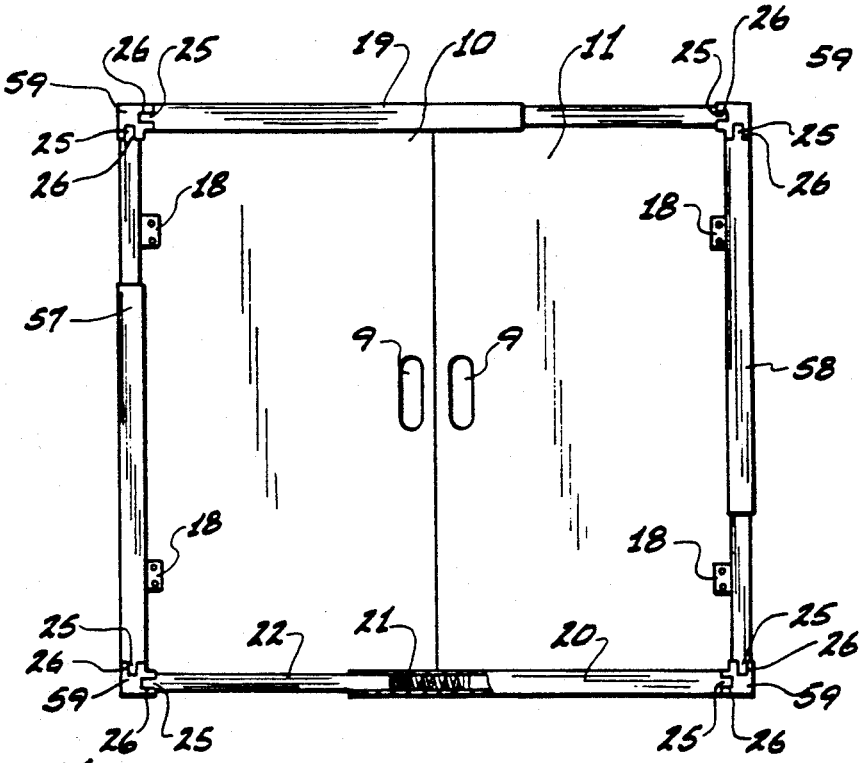
FIG. 7 is a top plan view of a playpen with a further embodiment where there are four removable sides each connected to a corner post.
Figure 8:
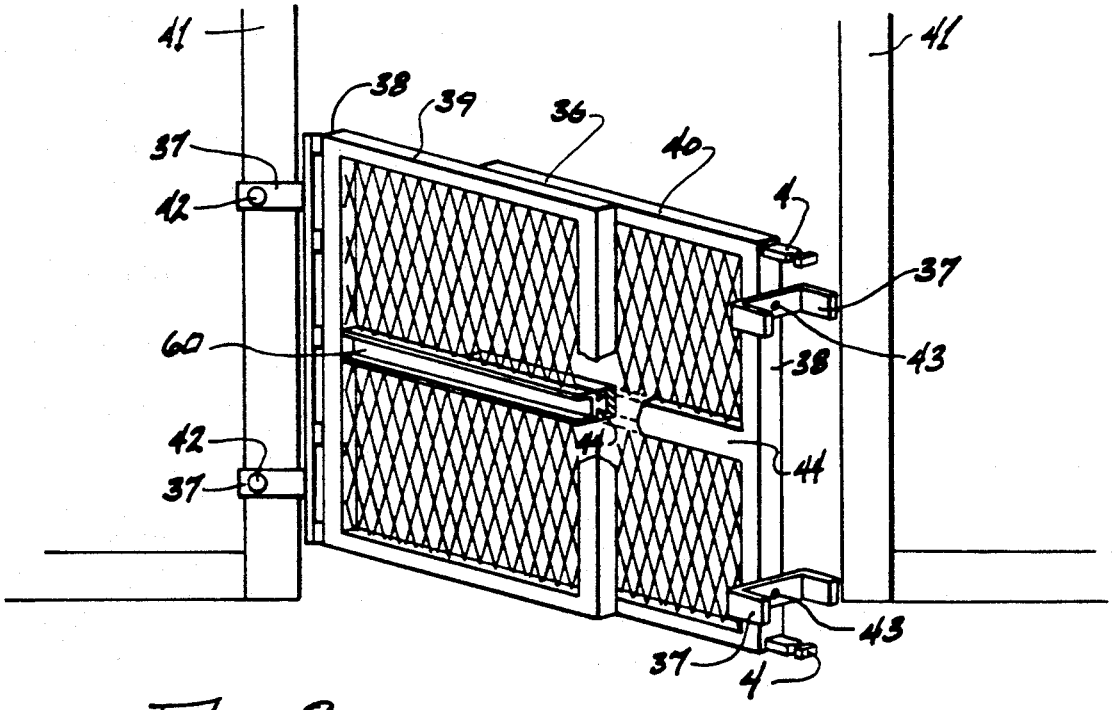
FIG. 8 is a side perspective view of another embodiment where the removable side or sides has removable securing means.
Figure 9:
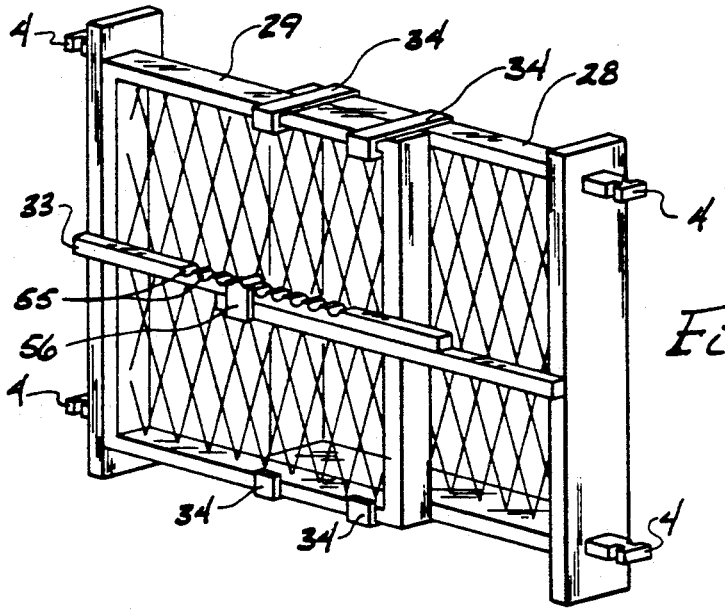
FIG. 9 is a side perspective view of an additional removable side having sliding panels with a center locking securing means and terminal end connecting means.
Figure 10:
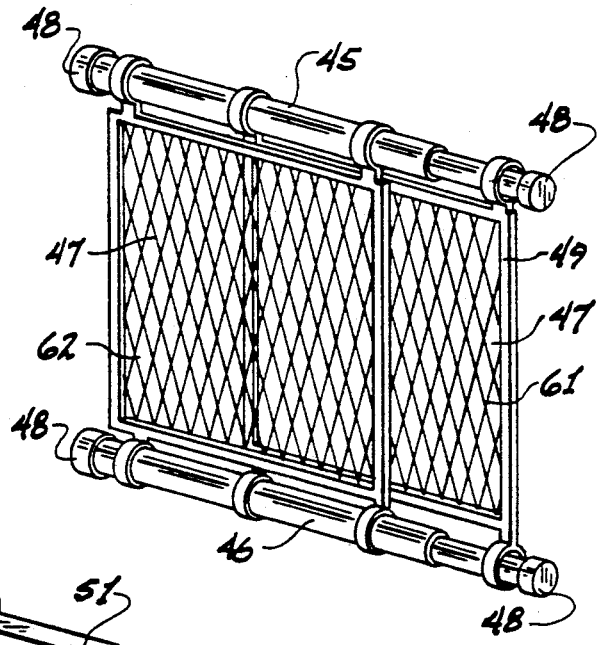
FIG. 10 is a side perspective view of yet another embodiment of the removable side or sides having pressure or spring-loaded telescoping tubes similar to the removable sides shown in FIG. 5.
Figure 11:
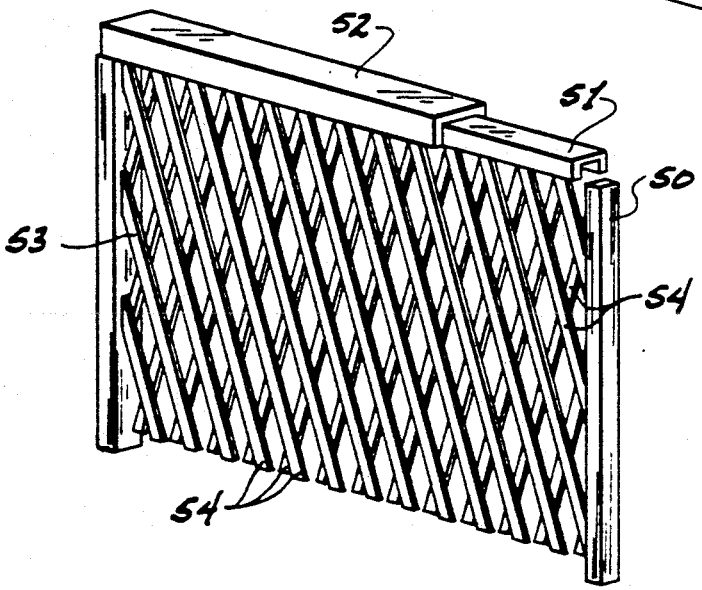
FIG. 11 is still another embodiment of a removable side having an expansion gate that can be used with securing means on each vertical terminal portion.

In FIGS. 5 and 7 a top view of another embodiment of this invention is shown in FIG. 5 where two removable sides 19 and 20 are provided and in FIG. 7 four removable sides 19, 20, 57 and 58 are provided. These sides 19 and 20 in FIG. 5 (and 57 and 58 in FIG. 7) have a tubular telescoping configuration with a centrally-positioned spring 21 which abuts a terminal portion of the small diameter tube 22. As tube 22 is pushed inwardly, the side 20 or 19 becomes shorter and is disengageable from non-removable sides 23 and 24 in FIG. 5 and from end posts 59 in FIG. 7. The end portions of sides 19 and 20 (and 57 and 58) can have extensions 25 which fit into a groove or slot 26 in non-removable sides 23 and 24 or in posts 59 in FIG. 7. Hinges 18 are seen providing floor sections 10 and 11 with folding means to fold sections 10 and 11 when the playpen is to be stored or is not in use. Handles 9 are used to lift the sections 10 and 11 upward. The removable sides 19 and 20 are similar in configuration to an adjustable shower curtain rod used across a bath tub. In FIG. 6 another removable side 27 is shown consisting of two slidable panels 28 and 29 which operate similar to an adjustable window screen. This figure shows one removable side 27, however, one to four sides can be removable, if desired. In this figure sides 30, 31 and 32 are not removable. When side 27 is removed from the playpen it is fitted into a door opening and expanded to whatever size width that will abut tightly against the door frame sides. It can then be locked at that width by the securing means 33 shown in FIG. 9. Panels 28 and 29 are slidably connected by panel brackets 34 which permit side 27 to be opened or closed to be locked for any size door opening, i.e. 30–60 inches wide. FIG. 9 illustrates a locking or securing means 33 made up of notches 55 and a notch bracket 56 which fits into the desired notch to lock sides 28 and 29 in place. A connecting means 4 is shown which can be used on all embodiments of this invention. T-shaped connecting means 4 can fit into any groove 5 as shown in FIG. 1. Connecting means 4 are located preferably on all four corners of removable side 27. In FIG. 8 a removable side 36 is shown having slidable panels 39 and 40 as in FIG. 9 except the embodiment of FIG. 8 has removable or attachable bracket securing means 37. These securing means 37 can be attached to the outer sides 38 of each panel 39 and 40 by a screw or bolt 43 easily connected to sides 38. If desirable, these securing means 37 can remain on the removable side 39–40 and used also as the connecting means. When removable side 36 is to be used as a playpen side, then bracket securing means 37 can be removed, if desired. Bracket securing means 37 fit around and are tightened onto a door frame 41 by tightening bolts 42. Connecting means 4 are used in the same manner as shown in FIG. 1 fitting in a groove 5 of adjacent sides or posts. Panel 39 has a center section 60 which slides in the middle groove 44 of panel 40 to open (increase) or close (decrease) the width of side 36. In FIG. 10 a top tube and a bottom tube 45 and 46, respectively, are shown having a plastic mesh 47 attached to each. Tubes 45 and 46 have components which telescope into each other and are held in position by outwardly urging spring means similar to FIG. 5. The securing means or rubber ends 48 of each tube is resilient and each can be spring-loaded or can have only resilient rubber tips 48, if desired. These rubber end portions 48 can fit into a large groove in the non-removable sides (larger than shown in FIG. 1) when used as the connecting means in a playpen. When used as a security gate, ends 48 would fit tightly against a door frame to hold the removable side 49 in place. Here ends 48 act as both the connecting means and securing means. Panels 61 and 62 of FIG. 10 are movable upon each other as are window screen panels or the panels of FIGS. 8 and 9. Grooves such as 60 and 44 of FIG. 8 or brackets 34 of FIG. 9 may be used to hold panels 61 and 62 movably together at their top and bottom frames 63 and 64, respectively. In FIG. 11 an expansion type gate is shown as removable side 50. This type side or gate 50 adjusts to fit door openings of from 24 to 60 inches or greater and swings completely open in two directions. In other words, if one panel is 24 inches wide it will open to 48; if one panel is 30 inches it will open to 60 inches. It can close compactly when not in use and has a top retaining rail 51 to slide or telescope into wider rail 52 when opening or closing the width of the gate 50 or the side of the playpen. The body 53 can be made up of diagonally crossing bars 54 each of which pivots on the other.

It should be understood that while this disclosure defines the security gate as being used with door openings, the gate can be used for any desired purpose. For example, the security gate can be used on stair landings, windows or any other opening requiring a security gate. The preferred and optimumly preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A playpen having in combination a floor section and substantially perpendicular to said floor section an enclosing structure which forms a fence-like enclosure around said floor section, at least a portion of said enclosing structure being removable from said playpen, said portion defining a removable section, said removable section having connecting means adapted to be connected to a remaining portion of a non-removable portion of said enclosing structure, said removable section also comprising a securing means, said securing means adapted to be secured to a door frame when said removable section is to be used as a security gate, said removable section having at least a portion of its width dimension laterally adjustable to thereby frictionally and securing fit between door frames that define openings of various widths.

2. The playpen of claim 1 wherein said playpen is of a square or rectangular configuration having four sides which make up said enclosing structure, at least one of said sides being removable from a remaining portion of said enclosing structure.

3. The playpen of claim 1 wherein said playpen is a square or rectangular configuration having four sides which make up said enclosing structure, wherein from two to four sides are removable from said playpen.

4. The playpen of claim 1 wherein said playpen has four upwardly extending posts upon which portions of said enclosing structure are removably attached by connecting means.

5. The playpen of claim 1 wherein said connecting means comprises spring-loaded terminal sections that attach onto a portion of said enclosing structure.

6. The playpen of claim 1 wherein said securing means comprises means to fit securely against a door frame when used as a security gate.

7. The playpen of claim 1 wherein said connecting means and said securing means are the same structure.

8. The playpen of claim 1 wherein said connecting means and said securing means are different structures.

9. The playpen of claim 1 wherein said enclosed structure is of a square or rectangular configuration which surrounds a similar square or rectangular floor section, said enclosing structure having at least one removable side that can be independently used as a security gate.

10. A playpen having in combination a floor section and substantially perpendicular to said floor section an upwardly extending enclosing structure which forms a fence-like enclosure around said floor section, said floor section and said enclosing structure having a substantially rectangular configuration, said enclosing structure having sides at least one of which is removable from a remainder or non-removable portion of said enclosing structure thereby defining a removable section, said removable section having connecting means adapted to connect said removable section to said remainder of said enclosing structure when said removable section is a component of said playpen, said removable section also comprising a securing means, said securing means specifically adapted to secure said removable section to a door frame when said removable section is to be used as a security gate, said removable section having at least a portion of its width dimension laterally adjustable to thereby frictionally and security fit between door frames that define openings of various widths.

11. The playpen of claim 10 wherein said playpen is of a rectangular configuration having four sides which make up said enclosing structure, at least one of said sides being removable from a remaining portion of said enclosing structure.

12. The playpen of claim 10 wherein said playpen is a rectangular configuration having four sides which make up said enclosing structure, wherein from two to four sides are removable from said playpen.

13. The playpen of claim 10 wherein said playpen has four upwardly extending posts to which portions of said removable structure are removably attached.

14. The playpen of claim 10 wherein said connecting means comprises spring-loaded terminal sections that attach onto a remainder of said enclosing structure.

15. The playpen of claim 10 wherein said securing means comprises means to fit securely against a door frame when used as a security gate.

16. The playpen of claim 10 wherein said connecting means and said securing means are the same structure.

17. The playpen of claim 10 wherein said connecting means and said securing means are different structures.

* * * * *